US008974200B2

(12) United States Patent
Chan et al.

(10) Patent No.: US 8,974,200 B2
(45) Date of Patent: Mar. 10, 2015

(54) DEVICE FOR CREATING FLUID FLOW

(75) Inventors: Johan Junior Chan, Marine Crescent (SG); Yiduo Li, Singapore (SG); Wei Chih Pan, Chua Chu Kang Crescent (SG); Andrew Yong Liang Soon Ng, Singapore (SG); James Sai Cheong Tam, Singapore (SG)

(73) Assignee: International Business Machines Corporation, Armonk, NY (US)

( * ) Notice: Subject to any disclaimer, the term of this patent is extended or adjusted under 35 U.S.C. 154(b) by 702 days.

(21) Appl. No.: 13/179,080

(22) Filed: Jul. 8, 2011

(65) Prior Publication Data

US 2013/0008545 A1 Jan. 10, 2013

(51) Int. Cl.

| | |
|---|---|
| ***F04B 43/00*** | (2006.01) |
| ***F04B 17/00*** | (2006.01) |
| ***F04B 35/04*** | (2006.01) |
| ***F04C 21/00*** | (2006.01) |
| ***F04D 1/04*** | (2006.01) |
| ***F04B 43/04*** | (2006.01) |
| ***F04B 45/047*** | (2006.01) |

(52) U.S. Cl.

CPC ..... *F04B 43/0054* (2013.01); *F04B 43/04* (2013.01); *F04B 45/047* (2013.01)

USPC ..... 417/480; 417/410.1; 417/481; 138/39

(58) Field of Classification Search

USPC ..... 417/410.1, 411, 412, 413.1, 479, 480, 417/481

See application file for complete search history.

(56) References Cited

U.S. PATENT DOCUMENTS

| | | | | |
|---|---|---|---|---|
| 2,829,601 | A * | 4/1958 | Weinfurt et al. | 417/413.1 |
| 3,166,239 | A * | 1/1965 | Greenhalgh et al. | 92/100 |
| 5,876,187 | A * | 3/1999 | Forster et al. | 417/322 |
| 6,589,028 | B1 * | 7/2003 | Eckerbom et al. | 417/413.1 |
| 6,644,944 | B2 | 11/2003 | Karp | |
| 7,284,966 | B2 * | 10/2007 | Xu et al. | 417/395 |
| 8,272,850 | B2 * | 9/2012 | Stenberg | 417/413.1 |
| 2003/0082056 | A1 * | 5/2003 | Ohya et al. | 417/53 |
| 2007/0035213 | A1 * | 2/2007 | Nakajima | 310/348 |

(Continued)

OTHER PUBLICATIONS

S.J Majumdar and N. Peake, Noise Generation by the Interaction Between Turbulence and a Rotating Fan, J. Fluid Mech. (1998), vol. 359, pp. 181-216, http://www.gidb.itu.edu.tr/staff/soylemez/underwater/bladerunner.pdf, last revised Nov. 18, 1997.

(Continued)

*Primary Examiner* — Charles Freay
*Assistant Examiner* — Lilya Pekarskaya
(74) *Attorney, Agent, or Firm* — Kunzler Law Group; Damion Josephs

(57) ABSTRACT

An apparatus and method are disclosed for inducing fluid flow. A fluid flow apparatus includes a directional membrane, a directional flow mechanism, and an oscillation module. The directional membrane allows a fluid to pass through the directional membrane in a first direction and resists fluid passing through the directional membrane in a second direction, the first direction substantially opposite the second direction. The directional flow mechanism allows a fluid to flow in a third direction and resists fluid flow in a fourth direction, the third direction substantially opposite the fourth direction. The oscillation module induces an oscillation in the directional membrane, wherein the oscillation of the directional membrane induces a flow of the fluid through the directional membrane in the first direction.

9 Claims, 11 Drawing Sheets

(56) References Cited

U.S. PATENT DOCUMENTS

| | | | | |
|---|---|---|---|---|
| 2009/0087323 | A1* | 4/2009 | Blakey et al. | 417/413.2 |
| 2010/0150753 | A1 | 6/2010 | Busch et al. | |
| 2010/0307616 | A1 | 12/2010 | Liou et al. | |
| 2010/0310398 | A1* | 12/2010 | Van Rensburg et al. | 417/488 |
| 2011/0223581 | A1* | 9/2011 | Stobbe | 435/3 |

OTHER PUBLICATIONS

Fernandez et al., Turbulence and Secondary Flows in an Axial Flow Fan With Variable Pitch Blades, Journal of Fluids Engineering, http://cat.inist.fr/?aModele=afficheN&cpsidt=20332309, 2008.

Mahalingam et al., Synthetic Jets for Forced Air Cooling of Electronics, Nuventix Inc., ElectronicsCooling vol. 13, No. 2, May 2007.

Fedala et al., Incident Turbulence Interaction Noise for an Axial Fan, AIAA 2006-2477, http://pdf.aiaa.org/preview/CDReadyMAERO06_1268/PV2006_2477.pdf, May 8-10, 2006.

SynJet Technology, About SynJet Cooling Technology, Nuventix, http://www.nuventix.com/technology/, Lat retrieved Apr. 27, 2011.

* cited by examiner

DEVICE FOR CREATING FLUID FLOW

FIELD

The subject matter disclosed herein relates to fluid flow apparatus and methods and more particularly relates to fluid flow apparatus that induce fluid flow through a directional membrane.

BACKGROUND

Description of the Related Art

Fluid flow apparatuses that induce a flow of fluid are used in a variety of applications and for a variety of purposes. For example, fluid flow apparatuses are commonly used to provide fluid flow for cooling of devices or living environments, to increase or decrease pressure in a cavity, or provide thrust for a vehicle such as a boat or airplane.

One common fluid flow apparatus available in the art includes a bladed fan. The blades of the fan are often rotated using a motor, such as an electric motor, which then force fluid in a desired direction. However, as the blades rotate they "chop" the fluid and do not provide very smooth fluid flow. The "chopping" can lead to buffeting which can be uncomfortable to humans or animals, for example when a fan is used to move air. Additionally, the "chopping" can lead to turbulent fluid flow which results in inefficient movement of fluid.

One use for bladed fans is for cooling warm or hot devices. For example, bladed fans are often mounted on heat sinks to help cool a processor in a computing device. Heat sinks often include numerous protrusions such as fins or rods which increase the surface area of the heat sink. A bladed fan is often used to move air through the protrusions to cool the heat sink and thereby cool a corresponding device. However, due to the turbulence created by bladed fans flow through heat sinks is often less than desirable. Furthermore, the turbulence may inhibit the minimum size of gaps between protrusions through which fluid can flow.

Additionally, since electronic devices often require cooling to operate efficiently, shrinking electronic devices often create significant design challenges for designers and engineers. However, fluid flow apparatuses used in the art generally require an electric motor for inducing air flow. Because electric motors are generally quite large and heavy, their use can be a limiting factor in the size of many devices.

BRIEF SUMMARY

From the foregoing discussion, it should be apparent that a need exists for an apparatus and method that can be used to induce airflow having reduced turbulence. Beneficially, such an apparatus and method would be able to induce airflow efficiently while allowing for a compact form factor.

The present invention has been developed in response to the present state of the art, and in particular, in response to the problems and needs in the art that have not yet been fully solved by currently available fluid flow apparatuses. Accordingly, the present invention has been developed to provide an apparatus and method for inducing fluid flow that overcome many or all of the above-discussed shortcomings in the art.

The apparatus to induce fluid flow may include a directional membrane, a directional flow mechanism, and an oscillation module. The directional membrane may allow a fluid to pass through the directional membrane in a first direction and resist fluid passing through the directional membrane in a second direction, where the first direction is substantially opposite the second direction. The directional flow mechanism may allow a fluid to flow in a third direction and resist fluid flow in a fourth direction, where the third direction substantially opposite the fourth direction. The oscillation module may induce an oscillation in the directional membrane. The oscillation of the directional membrane induces a flow of the fluid through the directional membrane in the first direction.

A method of the present invention is also presented for inducing fluid flow. The method in the disclosed embodiments substantially includes the steps necessary to carry out the functions presented above with respect to the operation of the described apparatus. The method may include providing a directional membrane. The directional membrane may allow a fluid to pass through the directional membrane in a first direction and resist fluid passing through the directional membrane in a second direction. In one embodiment, the first direction may be substantially opposite the second direction.

The method may include providing a directional flow mechanism. The directional flow mechanism may allow a fluid to flow in a third direction and resist fluid flow in a fourth direction. The third direction may be substantially opposite the fourth direction. The method may further include inducing an oscillation in the directional membrane. The oscillation of the directional membrane induces a flow of the fluid through the directional membrane in the first direction and through the directional flow mechanism in the third direction.

In one embodiment, the apparatus to induce fluid flow includes a structure, first directional membrane, a second directional membrane, and an oscillation module. The structure may include a first opening and a second opening and a cavity disposed within the structure between the first opening and the second opening.

The first directional membrane may be disposed over the first opening. The first directional membrane may allow a fluid to pass through the first directional membrane in a first direction and resist fluid passing through the first directional membrane in a second direction. The first direction may be substantially opposite the second direction. The first direction may be a direction away from the interior of the cavity. The first directional membrane may include a magnetic material.

The second directional membrane may be disposed over the second opening. The second directional membrane may allow a fluid to pass through the second directional membrane in a third direction and resist fluid passing through the directional membrane in a fourth direction. The third direction may be substantially opposite the fourth direction. The third direction may be a direction towards the interior of the cavity. The second directional membrane may include a magnetic material.

The oscillation module may induce an oscillation in the first directional membrane and the second directional membrane. The oscillation of the first directional membrane and the second directional membrane may induce a flow of the fluid through the cavity. The oscillation module may include an electromagnet and the oscillation module may induce an oscillation in the first directional membrane and the second directional membrane by creating an alternating magnetic field. The magnetic field may selectively attract and repel the magnetic materials of the first directional membrane and the second directional membrane.

References throughout this specification to features, advantages, or similar language do not imply that all of the features and advantages may be realized in any single embodiment. Rather, language referring to the features and advantages is understood to mean that a specific feature, advantage, or characteristic is included in at least one embodiment. Thus, discussion of the features and advantages, and similar language, throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1:
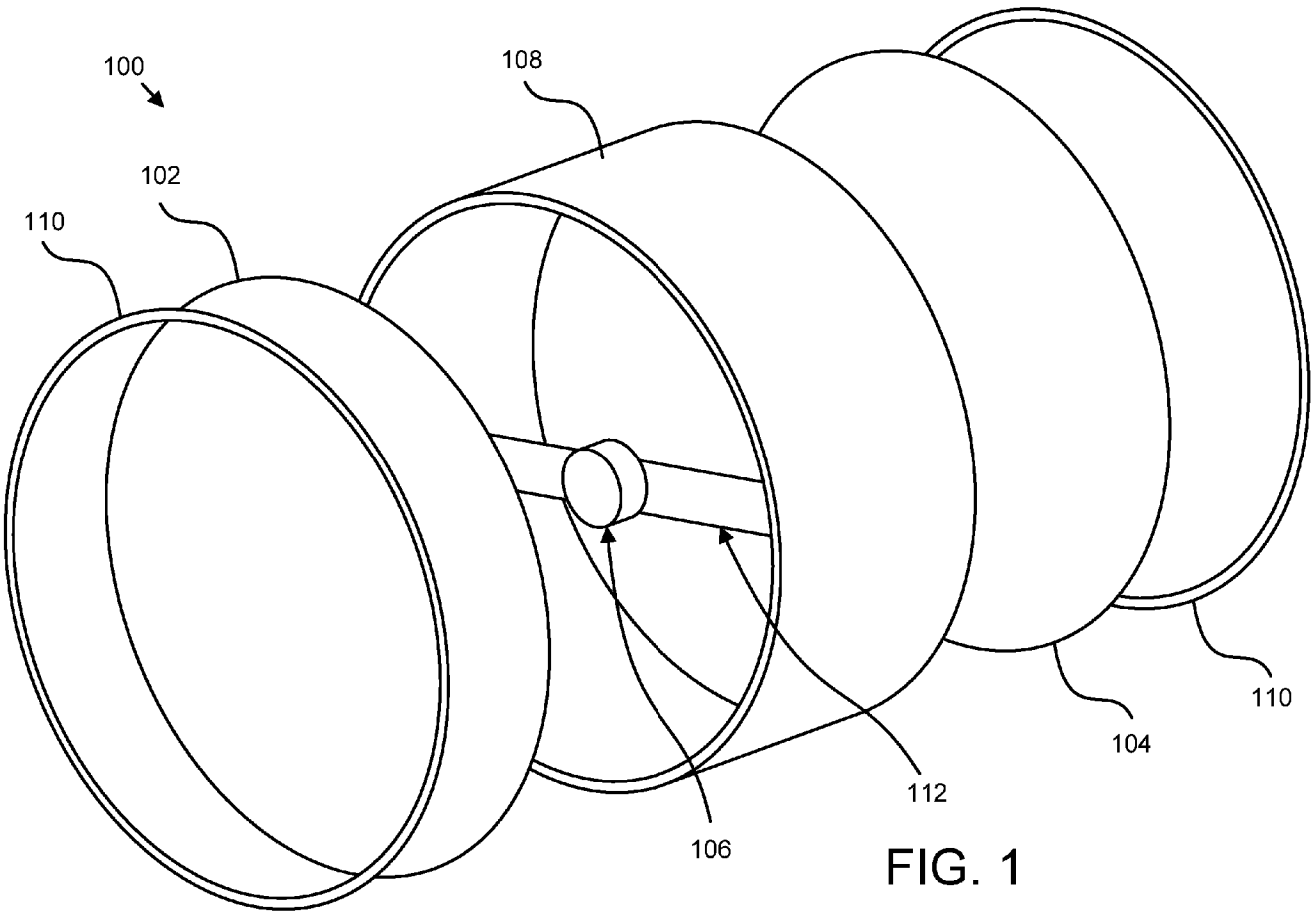
FIG. 1 is a perspective view of the components of an unassembled fluid flow apparatus in accordance with the present invention.

Many of the functional units described in this specification have been labeled as modules, in order to more particularly emphasize their implementation independence.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "may include," "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the embodiments may be combined in any suitable manner. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and computer program products according to embodiments of the invention.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module.

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware.

FIG. 1 is a perspective view illustrating exemplary components of one embodiment of a fluid flow apparatus 100. The fluid flow apparatus 100 includes a first directional membrane 102, a second directional membrane 104, an oscillation module 106, and a structure 108. The fluid flow apparatus 100 is also depicted including two attachment rings 110 for mounting the first and second directional membranes 102, 104 to the structure 108. The components 102-112 are exemplary only and provided for illustrative purposes only.

In one embodiment, the fluid flow apparatus 100, when assembled, may be used to induce flowing of a fluid through the directional membranes 102, 104 by inducing an oscillation of one or both of the membranes. As used herein, the term fluid is given to mean a substance having no fixed shape and that flows or deforms easily. Exemplary fluids may include any known liquid or gas. For example, the fluid flow apparatus 100 may be used to induce a flow of a liquid such as water or a gas such as air. The teachings found herein may be adapted for specific application for any type of desired fluid without limitation.

In one embodiment, the directional membranes 102, 104 allow for one-way flow of a fluid through the membranes. For example, each of the first directional membrane 102 and the second directional membrane 104 may allow a fluid to flow through each membrane in one direction but may resist the flow of fluid through the membrane from a substantially opposite direction. In one embodiment, for example, a directional membrane may include a first side and a second side and fluid may be allowed to flow from the first side through the membrane to the second side, but the flow of fluid from the second side through the membrane to the first side may be resisted. In one embodiment, the allowed flow may be in a direction substantially orthogonal to a surface of the membrane. In another embodiment, the allowed flow may be orthogonal and/or other than orthogonal but may still flow through the membrane. Further discussion and description of the directional membranes 102, 104 will take place in relation to later figures.

The oscillation module 106 may be used to induce an oscillation in one or both of the directional membranes 102, 104. In one embodiment, the oscillation module 106 is mounted on a support 112 within the structure 108. In another embodiment, the oscillation module 106 may be mounted to a directional membrane. For example, the oscillation module 106 may be mounted to an edge of a membrane or may be attached near a middle of a membrane. In another embodiment, the oscillation module 106 may induce an oscillation by means of creating a field, such as a magnetic or electric field that induces an oscillation in a directional membrane. In another embodiment, the oscillation module 106 may induce an oscillation via mechanical means, such as by using an electric motor to oscillate an arm or actuate gears that then induce a movement of a directional membrane.

The oscillation module 106 may induce an oscillation of the membrane back and forth in a direction substantially parallel to a direction of allowed fluid flow. In one embodiment, the oscillation module 106 may induce an oscillation of at least a portion of a directional membrane in a direction normal or orthogonal to a surface of the directional membrane. Further discussion regarding oscillation of the directional membranes will be provided in relation to later figures.

The structure 108 in the depicted embodiment acts as a rigid or semi-rigid structure for supporting the oscillation module 106 and directional membranes 102, 104 in relation to each other. In the depicted embodiment, the structure 108 includes a first opening and second opening over which the directional membranes 102, 104 may be disposed. The membranes 102, 104 may be secured to the structure using the attachment rings 110 and/or one or more other attachment means. In one embodiment, one or more fasteners, such as bolts, screws, or the like, may be used to secure the attachment rings 110 and the directional membranes 102, 104 to the structure. In one embodiment, an adhesive may be used to secure the membranes 102, 104 to the structure 108.

The attachment rings 110 for securing the directional membranes 102, 104 to the structure 108 are exemplary and for illustrative purposes only. In light of the present disclosure one of skill in the art will recognize that other embodiments may include other mechanisms for securing the directional membranes 102, 104 to the structure 108. For example, one or more fasteners and/or adhesives may be used to secure the membranes 102, 104 to the structure.

With the membranes 102, 104 secured to the structure, the oscillation module 106 may be used to induce an oscillation in one or both of the membranes 102, 104. In the depicted embodiment, oscillation of one or more of the directional membranes 102, 104 may induce a flow of fluid through the membranes 102, 104 and through the structure 108. In one embodiment, the oscillation module 106 induces an oscillation in only one of the directional membranes 102, 104. In another embodiment, the oscillation module 106 induces an oscillation in both of the directional membranes 102, 104. According to one embodiment, one or more oscillation modules 106 may be included to induce oscillations in one or more directional membranes.

In one embodiment, the fluid flow apparatus 100 may include only a single directional membrane. For example, in the embodiment of FIG. 1, the second directional membrane 104 may be replaced with any directional fluid flow mechanism known in the art. For example, a pressure actuated valve, flapper valve, or any other valve may be used to limit the flow of fluid in one direction but not another.

In one embodiment, the fluid flow apparatus 100 may help cool fluid as it flows through the apparatus. According to one embodiment, one or more of the structure and directional membranes 102, 104 may be formed of a thermally conductive material. In one embodiment, heat of a fluid flowing through the structure and/or membranes 102, 104 may be absorbed by the membranes and or structure. In one embodiment, the membranes and/or structure may carry the absorbed heat to a heat exchanger. For example, heat of a fluid may be absorbed by the directional membranes 102, 104 and/or structure 108 and conducted to a heat exchanger to cool the liquid. Any type of heat exchanger known in the art may be used. In one embodiment, heat is conducted to a peltier cooler or any other type of heat exchanger.

Further operation or configuration of various embodiments of fluid flow apparatus will be discussed in relation to later figures.

Figure 2A:
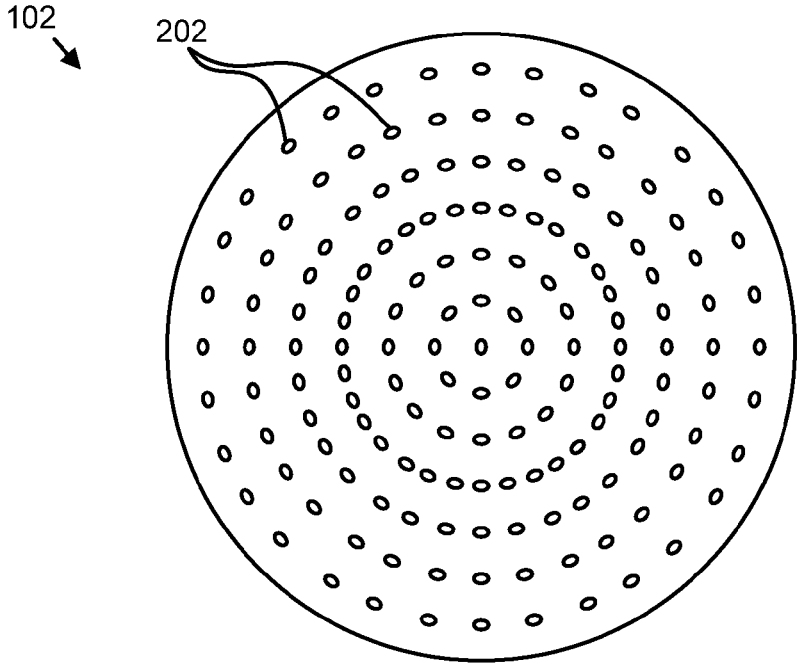
FIGS. 2A and 2B are front views of directional membranes in accordance with the present invention.
Figure 2B:
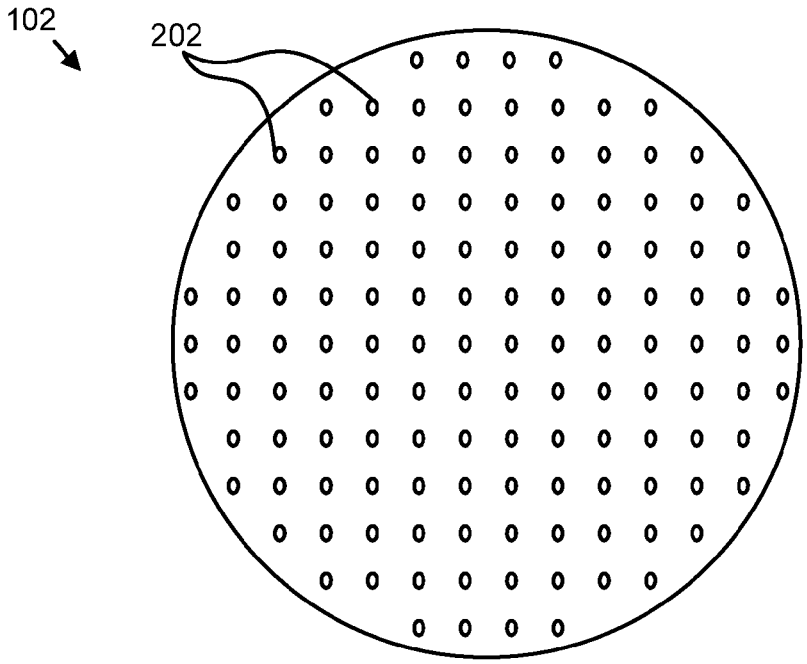

Turning now to FIGS. 2A-2B, 3A-3C, and 4A-4C exemplary operation and configuration of various embodiments of directional membranes will be discussed. Specifically, FIGS. 2A and 2B illustrate exemplary front views of the first directional membrane 102, according to varying embodiments. The depicted views are taken from a direction normal to a surface of the directional membrane 102.

In the depicted embodiments, the directional membrane 102 includes a plurality of valves 202. In one embodiment, the valves 202 may be anything that restricts flow in one direction but not another. For example, valves 202 may allow fluid to flow through the membrane 102 in one direction but resist the flow of fluid through the membrane 102 in a substantially opposite direction. In one embodiment, the valves 202 may be actuated by a difference in pressure. For example, a difference in pressure on different sides of the valve may cause the valve to open or close. For example, a higher pressure on one side of the valves 202 may result in fluid flowing through the valves 202 while a higher pressure an opposite side of the valves 202 may result in the valves resisting fluid flow, such as by closing. According to one embodiment, the membrane 102 may be impermeable to a fluid except through the valves 202. For example, if the valves 202 resist or allow fluid flow, the directional membrane 102 may respectively resist or allow fluid flow. Specific exemplary structures and functioning of the valves 202 may vary greatly and will be discussed further in relation to FIGS. 3A-3C and 4A-4C.

In one embodiment, the valves 202 are small compared to the membrane 102. For example, the valves 202 may be small enough compared to the directional membrane 102 such that a plurality of valves 202 may be included in the membrane 102. In one embodiment, a very large number of valves 202 may be included in a single membrane 102.

The number, placement and organization of the valves 202 on the membrane may vary considerably in different embodiments. In the embodiment depicted in FIG. 2A, the valves 202 are more densely packed near the center of the directional membrane 102 than near the outer edge. In the embodiment of FIG. 2B, the valves 202 are distributed at a uniform density throughout the surface of the directional membrane 102. Other variations in density as well as number of valves 202 are possible and may be desirable in different embodiments.

In one embodiment, the distribution of the valves 202 may vary based on a variety of considerations. For example, the rigidity of the membrane 102 may influence how the valves are distributed. In one embodiment, a flexible directional membrane 102 may have a varying density of valves 202, such as the distribution depicted in FIG. 2A. This may be desirable, for example, if the center of the directional membrane 102 oscillates a greater distance or at a higher speed than the outer edges of the directional membrane 102. For example, in the embodiment of FIGS. 7A and 7B the center of the directional membranes 102, 104 oscillate a greater distance and at a greater velocity than the edges of the directional membranes 102, 104. The increased density of the miniatures valves 202 may allow for an increased flow requirement at different portions of the membrane 102 and thereby allow for more efficient operation.

In one embodiment, a stiff and inflexible directional membrane 102 may have a uniform distribution of valves 202, such as the distribution depicted in FIG. 2B. This may be desirable, for example, if the whole membrane 102 oscillates the same distance or at the same speed. For example, in the embodiment of FIGS. 12A and 12B the center and edges of the directional membranes 102, 104 oscillate a uniform distance and at a uniform velocity. The uniform distribution of valves 202 may allow for uniform flow across the surface of the directional membrane 102.

Additional considerations for the density of the valves 202 may also include the size of the valves 202, the strength of the material from which the directional membrane 102 is formed, and other considerations. For example, if the valves 202 are smaller, they may be packed more densely on the surface of the directional membrane 102. It should be noted that the area occupied by a valve 202 may vary considerably. In some embodiments, the area occupied by the valves 202 may be much larger or smaller than depicted. Additionally, the valves 202 may weaken the directional membrane 102 and thus the strength of the material of the directional membrane 102 as well as the required strength for operation may also influence the density of the valves 202 in some embodiments.

Figure 3A:
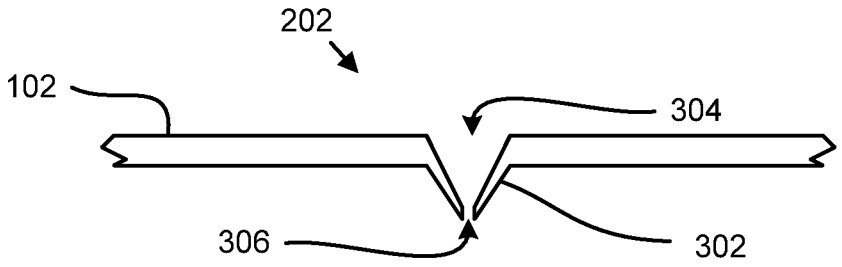
FIGS. 3A-3C are cross-sectional views of a valve in a directional membrane having a funnel shape in accordance with the present invention.
Figure 3B:
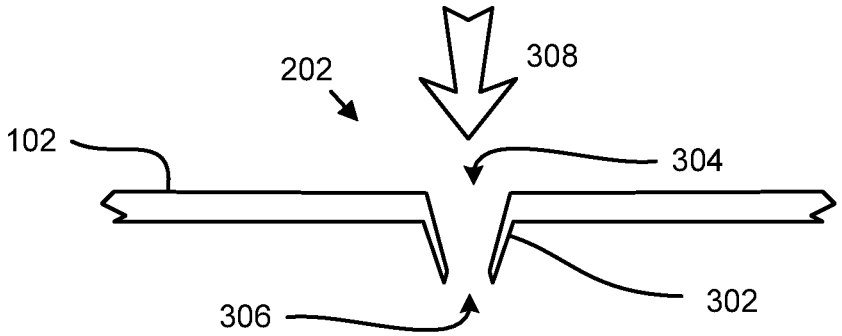
Figure 3C:
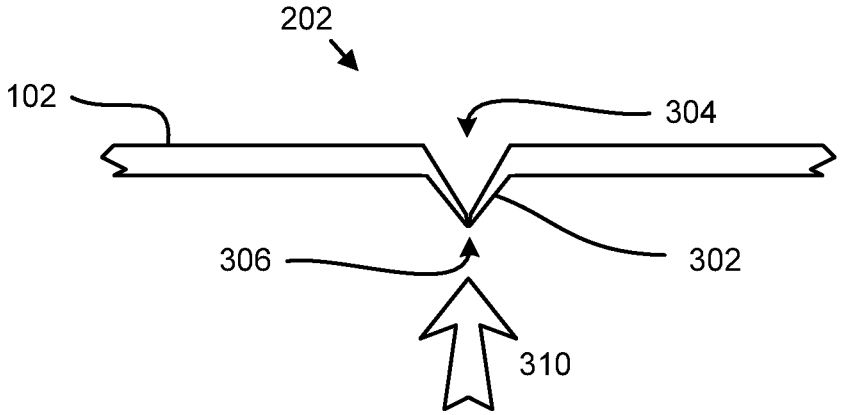

FIGS. 3A-3C illustrate cross-sectional views of a valve 202 having a funnel shape, according to one embodiment. According to a number of embodiments, the cross-sectional conical shape depicted may be due to a valve having a three-dimensional rectangular funnel, triangular funnel, circular funnel, or any other funnel shape.

FIG. 3A illustrates a valve 202 in the directional membrane 102 when little or no fluid is flowing through the membrane. Thus, FIG. 3A illustrates a cross-sectional shape of the valve 202 of a directional membrane 102 in a static or stationary state, according to one embodiment.

In the depicted embodiment, the valve 202 includes walls 302 forming a cross sectional cone shape. The valve 202 may include a larger opening 304 and a smaller opening 306. In one embodiment, fluid is allowed to flow into the larger opening 304, through the valve 202, and out the smaller opening 306 but flow in the opposite direction may be resisted. In one embodiment, the resistance of fluid flow from the smaller opening 306 through the valve 202 and out the larger opening 304 may vary depending on the rate of the fluid flow. For example, low or very low rates of flow may be able to pass through the smaller opening 306 and out the larger opening 304 but the valve 202 may close and allow no flow, or very little flow, if the flow rate begins to increase. In one embodiment, the valve 202 may not allow any flow of fluid into the smaller opening 306 and out the larger opening 304.

In one embodiment, the valve 202 is a pressure actuated valve. For example, in one embodiment the flow of a fluid through the valve 202 may be selectively allowed or resisted based on pressure differentials between different sides of the valve 202. For example, if a pressure near the larger opening 304 is greater than the pressure near the smaller opening 306 the valve 202 may allow fluid to through the valve by flowing into the larger opening 304 and out the smaller opening 306. Alternatively, if a pressure near the larger opening 304 is smaller than the pressure near the smaller opening 306 the valve 202 may resist fluid flow into the smaller opening 306 and out the larger opening 304. Fluid flow and pressure differentials will be further discussed in relation to FIGS. 3B and 3C.

The directional membrane 102 and valve 202 may be formed of a variety of materials in different embodiments. In one embodiment, the directional membrane 102 and valve 202 are formed of the same material. In one embodiment, the directional membrane and valve 202 may be formed of a soft and/or flexible material that allows the directional membrane and/or the walls of the valve 202 to flex and/or compress. For example, the directional membrane and valve may be formed of a rubber, a plastic, a flexible metal, or any polymeric material. In one embodiment, the directional membrane and/or valve 202 may be formed from a rigid or semi-rigid material. According to one embodiment, one or more of the directional membrane and the valve 202 are formed of one or more materials. For example, a portion of one or both of the directional membrane 102 and the valve 202 may be formed of a rigid material and or a soft or flexible material. For example, the directional membrane 102 and valve 202 may be formed of one or more of a metal, a plastic, a rubber, a polymeric material, and/or any other materials. In one embodiment, strong and small fibers, such as Mylar, carbon nano-tubes, or other fibers, may be used within the valve 202 and/or membrane 102 to increase structural strength and or longevity.

FIG. 3B illustrates the valve 202 allowing fluid to flow. In the depicted embodiment, the fluid is flowing relative to the directional membrane 102 in the direction indicated by arrow 308. Because the fluid is flowing in a direction allowed by the valve 202, fluid may be allowed to flow into the larger opening 304 between the walls 302 and out the smaller opening 306, as depicted. According to the depicted embodiment, the pressure provided by the flow of fluid in the direction indicated by arrow 308 forces the smaller opening 306 to expand and allow the fluid to pass through the membrane. For example the flow of fluid in the direction indicated by arrow 308 in relation to the valve 202 may cause the pressure above the smaller opening 306 to be greater than the pressure below the smaller opening 306. This may induce the smaller opening 306 to expand to allow fluid to flow.

FIG. 3C illustrates the valve 202 in a closed state resisting fluid flow. In the depicted embodiment, the fluid is flowing relative to the directional membrane 102 in the direction indicated by arrow 310. In other words, fluid is being forced in the direction indicated by arrow 310 relative to the directional membrane 102. Because the fluid is flowing, or is being forced relative to the directional membrane 102, in a direction in which flow is resisted by the valve 202, the fluid flow is resisted. According to the depicted embodiment, pressure provided by the flow or force of fluid in the direction of arrow 310 reduces the size of the smaller opening 306. In one embodiment, the smaller opening 306 may completely collapse to resist the flow of any fluid. For example the flow of fluid in the direction indicated by arrow 310 in relation to the valve 202 may cause the pressure bellow valve 202 and the smaller opening 306 to be greater than the pressure above the valve 202 and the smaller opening 306. This may induce the smaller opening 306 to shrink and/or close. The shrunken or closed smaller opening 306 may then resist the flow of fluid through the valve 202.

Fluid flow in the directions of arrow 308 and arrow 310 may result from a pressure differential on different sides of the valve 202. For example, the pressure near the larger opening 304 and within the valve 202 may be larger than the pressure near the smaller opening 306 and below the valve 202. This may induce fluid to flow in from the larger opening 304 to the smaller opening 306 in the direction indicated by arrow 308. This may induce an enlargement of the smaller opening 306, similar to the depiction of FIG. 3B. Alternatively, the pressure near the smaller opening 306 may be larger than the pressure near the larger opening 304. This may induce fluid to flow, or attempt to flow, in from the smaller opening 306 to the larger opening 304 in the direction indicated by arrow 310. This may induce a shrinking or collapsing of the smaller opening 306, similar to the depiction of FIG. 3C. According to one embodiment, when there is no pressure differential, or when the pressure near each side of the valve is the same no fluid flows through the valve. This may allow the smaller opening 306 to return to its static state, such as the state depicted in FIG. 3A.

In one embodiment, the difference in pressure on different sides of the valve 202 may be due to movement of the directional membrane 102 in relation to a fluid. For example, when the directional membrane 102 is moving in a direction substantially opposite to the direction indicated by arrow 308 pressure may build up on the side of the valve near the large opening 304. This may induce a fluid to flow through the valve 202 in the direction of arrow 308. Alternatively, when the directional membrane 102 is moving in a direction substantially opposite to the direction indicated by arrow 310 pressure may build up on the side of the valve near the small opening 306. This may induce a fluid to flow, or attempted fluid flow, through the valve 202 in the direction of arrow 310. In one embodiment, the movement of the directional membrane 102 may increase or decrease the volume of an enclosed cavity and thereby create pressure differentials between the interior of the cavity and an area external to the cavity.

In one embodiment, the pressure differentials may be the result of the oscillation of the directional membrane 102. In one embodiment, as the directional membrane 102 (and valve 202) oscillates in relation to a fluid the valve 202 may alternately allow and resist the flow of fluid. For example, the smaller opening 306 may enlarge when the directional membrane 102 is moved in a direction opposite allowed fluid flow and shrink when the directional membrane 102 is moved in a direction opposite resisted fluid flow. This may result in the alternating flowing of fluid through the directional membrane and pushing of fluid by the membrane. In this manner, an oscillation of the directional membrane 102 may induce the flow of a fluid.

The valve 202 of FIGS. 3A-3C is exemplary only. The shape, size, and proportions of the valve 202 may vary considerably. For example, various considerations such as the desired amount of fluid flow, desired efficiency, and/or the frequency of the oscillation of the membrane 102 may influence the size, shape, and proportions of the valve 202. For example, the larger and smaller opening 304, 306 may be increased in size to enable higher efficiency for a higher frequency oscillation. Additionally, the size of the smaller opening 306 in a static state may be increased or decreased for providing greater or reduced resistance to fluid flow. One of skill in the art will recognize in light of the present disclosure other variations of the shape, size, and proportions of the valve 202.

Figure 4A:
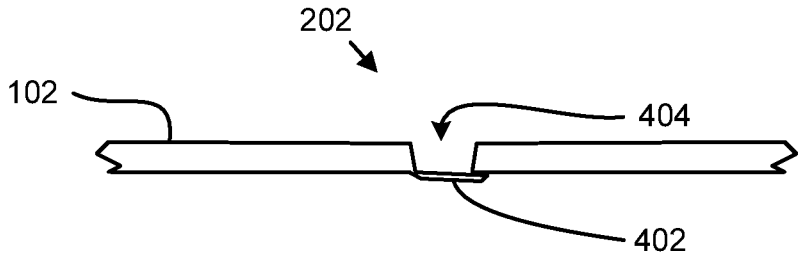
FIGS. 4A-4C are cross-sectional views of a valve in a directional membrane having a flap in accordance with the present invention.
Figure 4B:
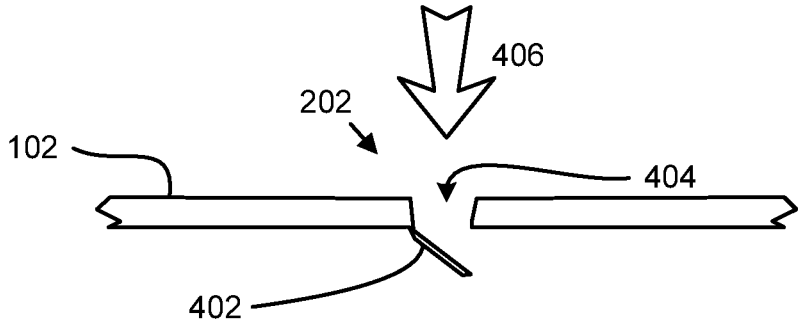
Figure 4C:
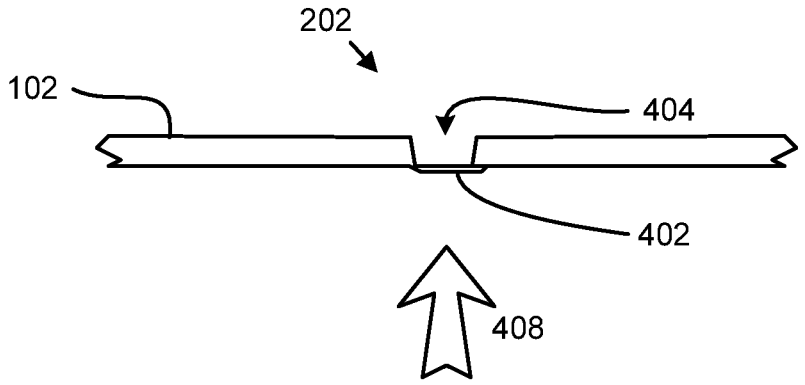

Turning now to FIGS. 4A-4C, another exemplary embodiment of a valve 202 will be discussed. Specifically, FIGS. 4A-4C illustrate cross-sectional views of a valve 202 having a flap 402. FIG. 4A illustrates a valve 202 in the directional membrane 102 when little or no fluid is flowing through the membrane, in one embodiment. Thus, FIG. 4A illustrates a cross-sectional shape of the valve 202 of a directional membrane 102 in a static or stationary state, according to one embodiment. In one embodiment, the valve 202 operates as a pressure actuated flapper valve.

The valve 202 includes a flap 402 and an opening 404. The flap 402 is illustrated as attached to the membrane 102 near one side of the opening 404 and in a closed position covering the opening 404. In one embodiment, the flap 402 is large enough to completely cover the opening 404. In one embodiment, the flap 402 is large enough to completely cover and overlap the sides of the opening 404. According to one embodiment, the flap 402 is attached to the directional membrane 102 at a side of the opening 404 such that the flap 402 is biased towards a closed position. In other embodiments, the flap 402 may be biased towards an at least partially open position. According to one embodiment, the flap 402 may be at least partially formed of a same material used to at least partially form the directional membrane 102. In one embodiment, the flap 402 may be formed of a different material than the directional membrane 102.

The directional membrane 102 and valve 202 may be formed of a variety of materials in different embodiments. In one embodiment, the directional membrane 102 and valve 202 are formed of the same material. For example, the directional membrane and valve 202 may be formed of a soft material that allows the directional membrane 102 and/or the flap 402 of the valve 202 to flex and/or compress. For example, the directional membrane 102 and valve 202 may be formed of a rubber, a plastic, or other polymeric material. According to one embodiment, one or more of the directional membrane and the valve 202 are formed of one or more materials. For example, a portion of one or both of the directional membrane 102 and the valve 202 may be formed of a rigid material and or a soft or flexible material. For example, the directional membrane 102 and valve 202 may be formed of one or more of a metal, a plastic, a rubber, a polymeric material, and/or any other materials. In one embodiment, fibers may be used to provide strength and durability while allowing the directional membrane 102 and/or valve 202 to flex.

FIG. 4B illustrates the valve 202 in an open state allowing fluid to flow. In the depicted embodiment, the fluid is flowing relative to the directional membrane 102 in the direction indicated by arrow 406. Because the fluid is flowing in a direction allowed by the valve 202, fluid may be allowed to flow into the opening 404 through the valve 202 and out the side close to the flap 402, as depicted. According to the depicted embodiment, the pressure provided by the flow of fluid in the direction indicated by arrow 406 forces the flap 402 to an open position allowing the fluid to pass through the membrane 102.

FIG. 4C illustrates the valve 202 resisting fluid flow. In the depicted embodiment, the fluid is flowing relative to the directional membrane 102 in the direction indicated by arrow 408. In other words, fluid is being forced in the direction indicated by arrow 408 relative to the directional membrane 102. Because the fluid is flowing, or is being forced relative to the directional membrane 102, in a direction in which flow is resisted by the valve 202 the fluid flow is resisted. According to the depicted embodiment, pressure provided by the flow or force of fluid in the direction of arrow 408 causes the flap 402 to move towards a closed position. In one embodiment, the flap closes and completely covers the opening 404 to resist the flow of fluid.

Fluid flow in the directions of arrow 406 and arrow 408 may result from a pressure differential on different sides of the valve 202. For example, the pressure on the side without the flap 402 may be larger than the pressure on the side with the flap 402. This may induce fluid to flow in to the opening 404 and out through the flap in the direction indicated by arrow 406. This may induce an opening of the flap 402, similar to the depiction of FIG. 4B.

Alternatively, the pressure near the side having the flap 402 may be larger than the pressure near the side without the flap 402. This may induce fluid to flow, or attempt to flow, in from the side with the flap 402 and out the other side of the directional membrane 102 in the direction indicated by arrow 408. This may induce the flap 402 to move to a closed position, similar to the depiction of FIG. 4C. According to one embodiment, when there is no pressure differential, or when the pressure near each side of the valve is the same no fluid flows through the valve. Little or no pressure differential may allow flap 402 to return to its static state, such as the state depicted in FIG. 4A.

In one embodiment, the difference in pressure on different sides of the valve 202 may be due to movement of the directional membrane 102 in relation to a fluid. For example, when the directional membrane 102 is moving in a direction substantially opposite to the direction indicated by arrow 406 pressure may build up on the side of the valve 202 opposite the flap 402. This may induce a fluid to flow through the valve 202 in the direction of arrow 406. Alternatively, when the directional membrane 102 is moving in a direction substantially opposite to the direction indicated by arrow 408 pressure may build up on the side of the valve 202 having the flap 402. This may induce a fluid to flow, or attempted fluid flow, through the valve 202 in the direction of arrow 408.

In one embodiment, the pressure differentials may be the result of the oscillation of the directional membrane 102. In one embodiment, as the directional membrane 102 (and valve 202) oscillates in relation to a fluid, the valve 202 may alternately allow and resist the flow of fluid. For example, the flap 402 may alternately move between a closed and an open position, allowing and resisting fluid flow. This may result of the alternating flowing of fluid through the directional membrane and pushing fluid by the membrane. In this manner, an oscillation of the directional membrane 102 may induce the flow of a fluid.

The valve 202 of FIGS. 4A-4C is exemplary only. The shape, size, and proportions of the valve 202 may vary considerably. For example, various considerations such as the desired amount of fluid flow, desired efficiency, and/or the frequency of the oscillation of the membrane 102 may influence the size, shape, and proportions of the valve 202. For example, the size and mass of the flap 402 may vary according to a desired oscillation rate. For example, smaller size and mass of the flap 402 may be desirable for faster rates of oscillation or a faster response to allowing or resisting flow. Alternatively, a desired for increased strength and/or efficiency of the flap 402 may lead to a larger size or mass of the flap 402.

Figure 5:
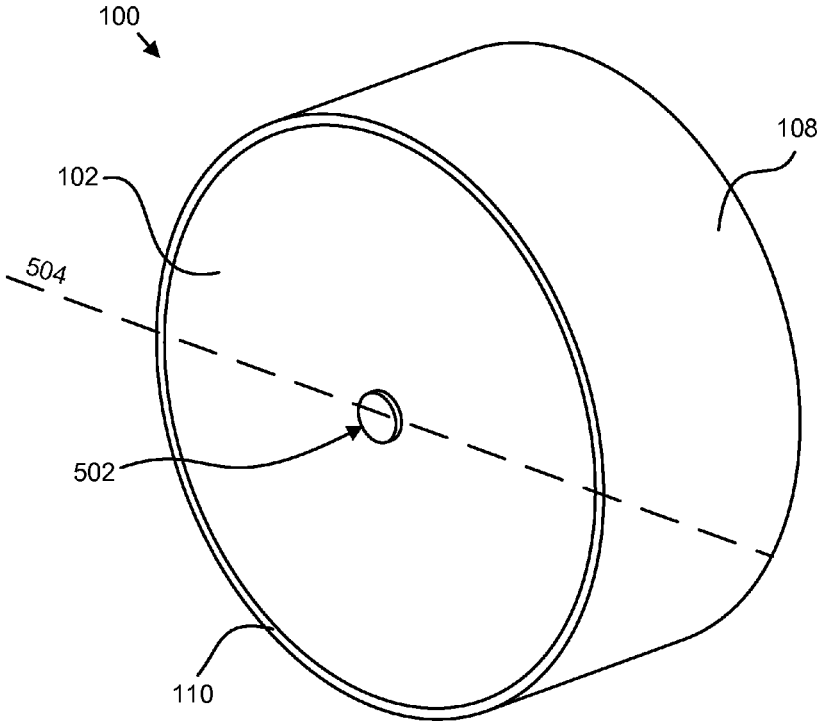
FIG. 5 is a perspective view of a fluid flow apparatus in accordance with the present invention.

Turning now to FIG. 5 a perspective view of an assembled fluid flow apparatus 100 is shown. According to one embodiment, the fluid flow apparatus 100 of FIG. 5 is an assembled version of the unassembled components of the fluid flow apparatus 100 of FIG. 1. According to one embodiment, the components of the fluid flow apparatus 100 may be the same as those of FIG. 1. In other embodiments, alternate or additional components may be included.

The fluid flow apparatus 100, includes a first directional membrane 102, a second directional membrane (not shown), and a structure 108. A magnet 502 is depicted affixed to the first directional membrane 102. The fluid flow apparatus 100 may also include an oscillation module 106 (not visible) at least partially disposed within the apparatus 100 that creates a magnetic field for imparting a force to the magnet 502 and thereby inducing an oscillation of the first directional membrane 102. The oscillation induced by the oscillation module 106 may include movement of the magnet 502 and attached directional membrane 102 in direction outwards from and inwards towards an interior of the apparatus 100. Also depicted is an attachment ring 110 that secures the membrane 102 to the structure 108.

Figure 6:
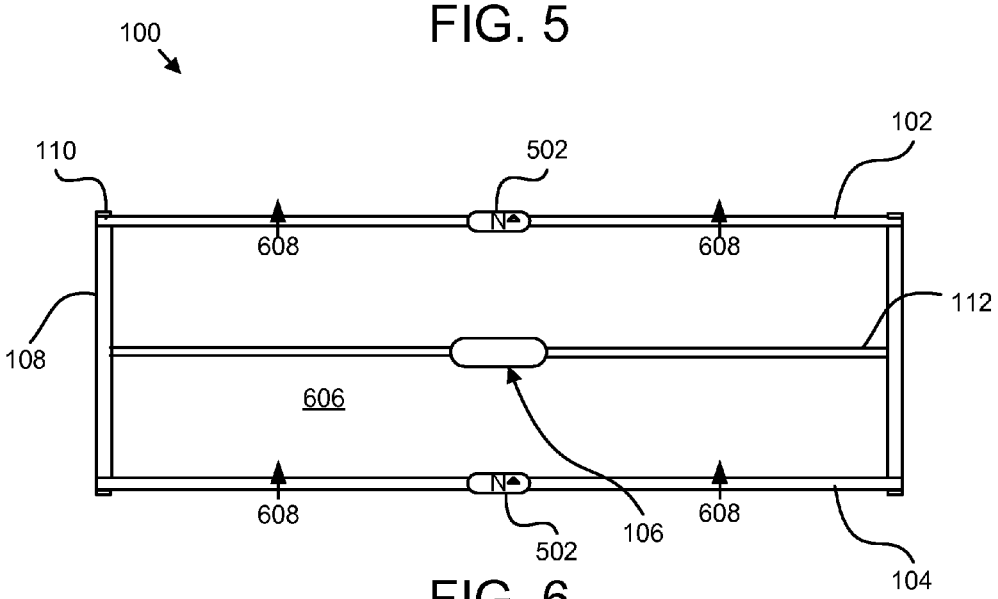
FIG. 6 is a cross-sectional top view of the fluid flow apparatus of FIG. 5 in accordance with the present invention.

FIG. 6 is an exemplary cross-sectional top view of the fluid flow apparatus 100 taken along a slice indicated by line 504. The top view illustrates the cross-sectional shape and configuration of the components of the fluid flow apparatus 100, according to one embodiment. The first directional membrane 102, second directional membrane 104, structures 108, and attachment rings 110 are shown. The structure 108 and the first and second directional membranes 102, 104 are depicted enclosing a cavity 606. An oscillation module 106 is depicted disposed within the cavity 606.

The directional membranes 102, 104 may be oriented such that they allow fluid flow in the direction indicated by arrows 608. In the depicted embodiment, the first directional membrane 102 allows fluid to flow from within the cavity 606 through the first directional membrane 102 and out of the cavity 606. The second directional membrane 104 allows fluid to flow from without the cavity 606 through the second directional membrane 104 into the cavity. According to one embodiment, as the oscillation module 106 induces oscillation of the directional membranes 102, 104 fluid is forced to flow upwards in the direction indicated by the arrows 608.

According to one embodiment, the directional membranes 102, 104 are flexible and are allowed to flex inward and outward from the apparatus 100. Other embodiments may include rigid membranes or partially rigid membranes.

According to the depicted embodiment, each of the first directional membrane 102 and the second directional membrane 104 has an attached magnet 502. The orientation of the magnetic fields of the magnets 502 are indicated as well. In the depicted embodiment, the magnets 502 are oriented such that their magnetic fields align. In the embodiment of FIG. 6, the oscillation module 106 includes an electromagnet. The electromagnet may be used to create a magnetic field for imparting a force to the directional membranes 102, 104 via the attached magnets. According to one embodiment, the aligned magnetic fields of the magnets 502 may cause them to be repelled at the same time or attracted at the same time by a magnetic field induced by the electromagnet of the oscillation module 106. Exemplary operation of the oscillation module 106 and apparatus 100 will be discussed in relation to FIGS. 7A and 7B.

Figure 7A:
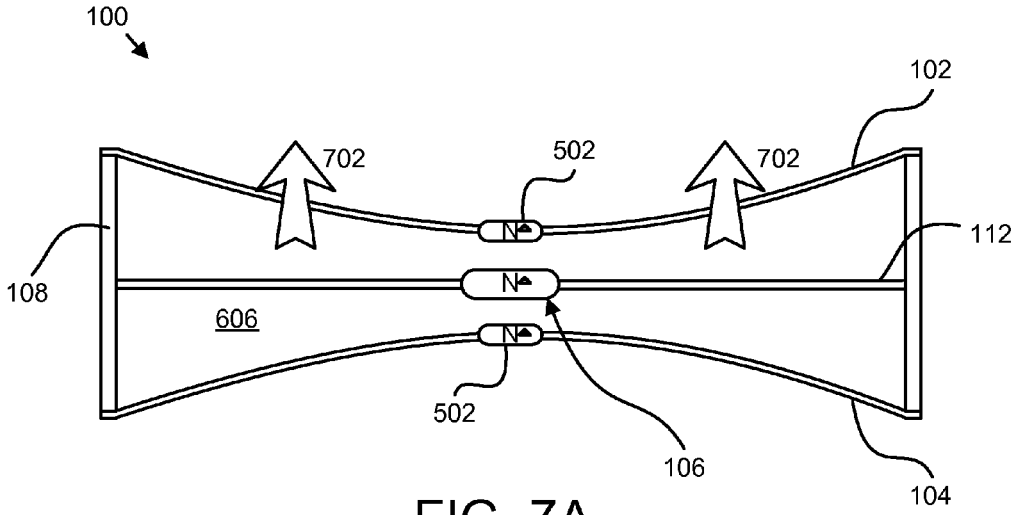
FIGS. 7A and 7B are cross-sectional top views of a fluid flow apparatus illustrating exemplary oscillation and induced fluid flow in accordance with the present invention.
Figure 7B:
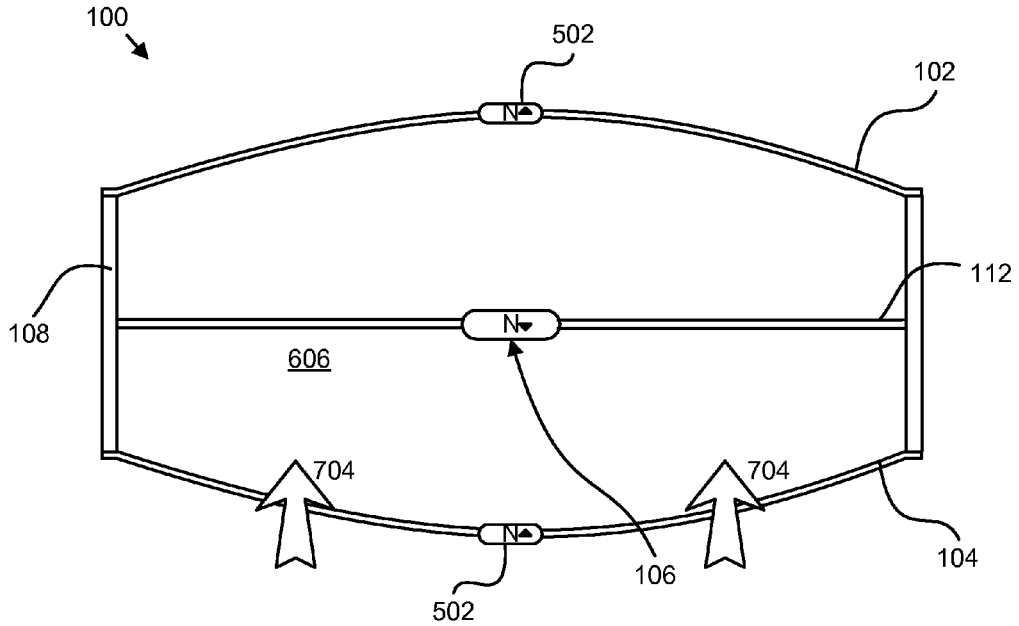

FIGS. 7A and 7B illustrate exemplary operation of the fluid flow apparatus 100 of FIG. 6 and depict its exemplary state at different points of an oscillation. FIG. 7A illustrates the flexing of the first membrane 102 and the second membrane 104 towards the interior of the cavity 606, according to one embodiment. The electromagnet of the oscillation module 106 is depicted having a magnetic field aligning with the magnets 502 of the first and second membranes 102, 104. According to one embodiment, the magnetic field may result from a current flowing through the electromagnet. The magnetic field may create a force drawing the magnets 502 toward the electromagnet of the oscillation module 106.

The first and second membranes 102, 104 are shown pulled towards the interior of the cavity 606 and the volume of the cavity 606 is reduced. This may create an increased pressure within the cavity allowing fluid to flow through the first directional membrane 102 out of the cavity, as indicated by arrows 702. According to one embodiment, fluid is not allowed to flow out of the cavity 606 through the second directional membrane 104 because it is oriented such that it resists flow in that direction (see arrows 608 of FIG. 6). Thus, as the membranes 102, 104 are drawn towards the electromagnet of the oscillation module 106 air is forced out of the cavity in the direction of arrows 702.

FIG. 7B illustrates the flexing of the first and second membrane 102, 104 away from the interior of the cavity 606. The electromagnet of the oscillation module 106 is depicted having a magnetic field opposing the magnets 502 of the first and second membranes 102, 104. According to one embodiment, the magnetic field may result from a current flowing through the electromagnet. For example, to create the opposing magnetic field a current may be reversed from the current provided in FIG. 7A. This may create a force pushing the magnets 502 away from the electromagnet of the oscillation module 106.

The first and second membranes 102, 104 are shown pushed away from the interior of the cavity 606 and the volume of the cavity 606 is significantly increased. This may create a decreased pressure within the cavity allowing fluid to flow through the second directional membrane 104 into of the cavity, as indicated by arrows 704. According to one embodiment, fluid is not allowed to flow into the cavity 606 through the first directional membrane 102 because it is oriented such that it resists flow in that direction (see arrows 608 of FIG. 6). Rather, as the first directional membrane 102 moves away from the interior of the cavity 606, a fluid may be pushed in front of it. Thus, as the membranes 102, 104 are pushed away from the electromagnet of the oscillation module 106 air is forced into the cavity in the direction of arrows 704.

According to one embodiment, an electrical signal may be supplied to the electromagnet of the oscillation module 106 to create an alternating magnetic field. The alternating magnetic field may provide an alternating push or pull on the magnets 502 and thus induce oscillation of the directional membranes 102, 104. According to one embodiment, as the oscillation continues the repeated repelling and pulling on the magnets 502 by the electromagnet of the oscillation module 106 continues to oscillate the directional membranes 102, 104 and produces an overall fluid flow in the direction of arrows 702 and 704. Thus the fluid flow apparatus 100 induces a flow of a fluid.

In one embodiment, the magnets 502 may be replaced with a magnetic but substantially non-polarized magnetic material. For example, the magnetic material may be replaced with a magnetic metal or the membrane itself may include a magnetic material. In one embodiment, the magnetic field created by the oscillation module 106 may include periodic attraction of the magnetic material to induce oscillation. For example, periods of inducing a magnetic field followed by periods of not inducing a magnetic field may induce an oscillation in the membrane.

According to one embodiment an electrical signal may be supplied by the oscillation module 106 or by an external device. For example, the oscillation module 106 may include circuitry which receives electrical power and produces a changing electrical signal. The changing electrical signal may include a sinusoidal wave, square wave, or any other type of electrical signal known in the art. In one embodiment, the oscillation module 106 and or an electromagnet may be controlled by an attached computing device. For example, software running on a computer or other computing device may provide instructions controlling the rate of oscillation. In one embodiment, the oscillation module 106 may include software executed by a processor, such as a microprocessor.

According to one embodiment, the fluid flow apparatus 100 of FIG. 5 may provide a number of advantages over fluid flow apparatus known in the art. In one embodiment, the apparatus may be more simple and easy to manufacture. For example, no gears, bearings, or rotating parts may be required in its construction. In one embodiment, the apparatus 100 may be capable of more compact and light manufacture. For example, the apparatus 100 may be manufactured without an electric motor which may be large and heavy. In one embodiment, the apparatus 100 may be very thin and may be included in devices where a small size is important. In one embodiment, the apparatus 100 may be safer than fluid flow apparatus using blades. The risk of injury to humans or damage to objects which contact the fluid flow apparatus may be nonexistent or minimal when compared to the use of blades.

In one embodiment, the apparatus 100 may reduce buffeting and or noise that can result from other types of fluid flow devices. For example, fan blades may cause buffeting which can be uncomfortable to humans or animals. Alternately, the fan blades may cause turbulence which may limit the effectiveness of fluid moved through a heat sink, such as between fins or protrusions of a heat sink on a microprocessor. The fluid flow apparatus 100 may provide a smoother flow of fluid and may reduce the amount of turbulence in the flow of fluid. In one embodiment, the fluid flow apparatus 100 induces a laminar flow of fluid where little or no turbulence is present. Laminar flow is given to mean fluid flow where molecules of a fluid move substantially parallel to each other and to an overall direction of fluid flow. Turbulence often includes eddy currents where molecules are moving orthogonal or even opposite from an overall current flow. The reduced turbulence and lack of buffeting may be a more efficient air flow for heat sink cooling as well as more comfortable for humans or animals.

Although FIGS. 6 and 7A-7B depict a fluid flow apparatus lacking a motor it should be noted that an electric motor may be desired in some embodiments. For example, an electric motor may be required to supply a needed amount of force. For example, one embodiment may require a high amount of force and size and weight of a fluid flow apparatus may be of lesser importance. In such a case, an electric motor may be used to induce an oscillation.

FIGS. 5, 6, and 7A-7B illustrate an actuation near a center of the directional membranes 102, 104 in order to induce oscillation. However, one of skill in the art will recognize that an actuation of a whole membrane or a portion of a membrane at any point on the membrane may be used to induce an oscillation. For example, actuation of the edges or any other portion of a membrane may be used to induce an oscillation of a membrane. In one embodiment, a carrier or structure attached to the edges of a membrane may be oscillated or actuated to induce an oscillation of the membrane. In one embodiment, the carrier or structure may be actuated by an electromagnet, solenoid, motor, or any other actuator known in the art.

Figure 8:
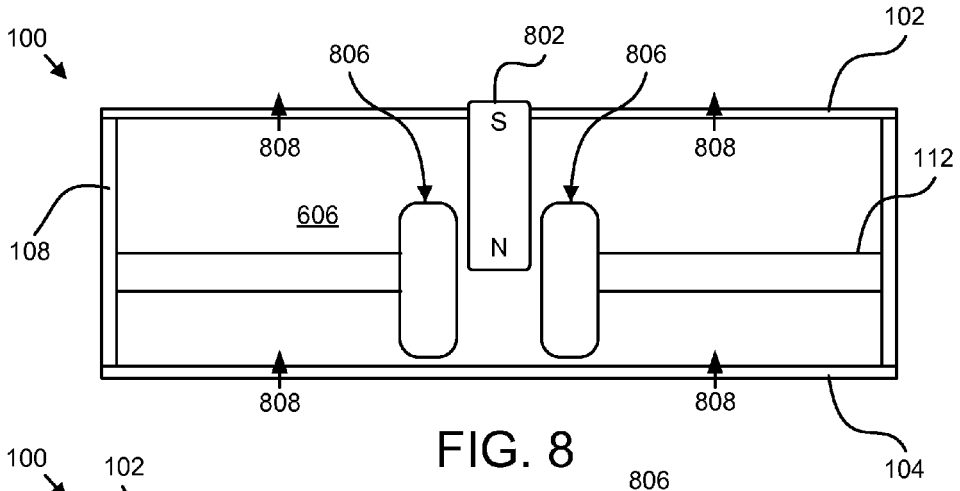
FIG. 8 is another cross-sectional top view of the fluid flow apparatus of FIG. 5 in accordance with the present invention.

FIG. 8 illustrates a cross-sectional view of the fluid flow apparatus 100 of FIG. 5 according to another embodiment. The apparatus 100 of the embodiment of FIG. 8 includes a first directional membrane 102, a second directional membrane 104, a structure 108 and a cavity 606 similar to the embodiment of FIG. 6. Additionally, the first directional membrane 102 is oriented to allow fluid to flow out of the cavity while the second directional membrane 104 is oriented to allow fluid to flow into the cavity, as indicated by arrows 708. The fluid flow apparatus 100 includes a plunger magnet 802 connected to the first directional membrane 102.

According to one embodiment, the oscillation module includes a solenoid 806. According to one embodiment, the two portions of the solenoid 806 represent different sides of the same solenoid 806. For example, the solenoid 806 may include a coil of wire that forms a loop around a hollow center. The plunger magnet 802 may act as a plunger or core of the solenoid 806. For example, when a current is induced through the solenoid 806 a magnetic field may be induced which imparts a force to the magnet 802. In one embodiment, the magnet 802 may be forced upwards or downwards depending on a direction of current flowing through the solenoid 806.

In one embodiment, the first directional membrane 102 is flexible while the second directional membrane 104 is rigid. According to one embodiment, the solenoid 806 and magnet 802 induce an oscillation in the first directional membrane 102 but do not induce an oscillation in the second directional membrane 104.

In one embodiment, the directional membranes 102, 104 may be oriented such that they allow fluid flow in the direction indicated by arrows 808. In the depicted embodiment, the first directional membrane 102 allows fluid to flow from within the cavity 606 through the first directional membrane 102 and out of the cavity 606. The second directional membrane 104 allows fluid to flow from without the cavity 606 through the second directional membrane 104 into the cavity. According to one embodiment, as the oscillation module 106 induces oscillation of the first directional membrane 102 fluid is forced to flow in the direction indicated by the arrows 808. Exemplary operation of the solenoid 806 and fluid flow apparatus 100 will be discussed in relation to FIGS. 9A and 9B.

Figure 9A:
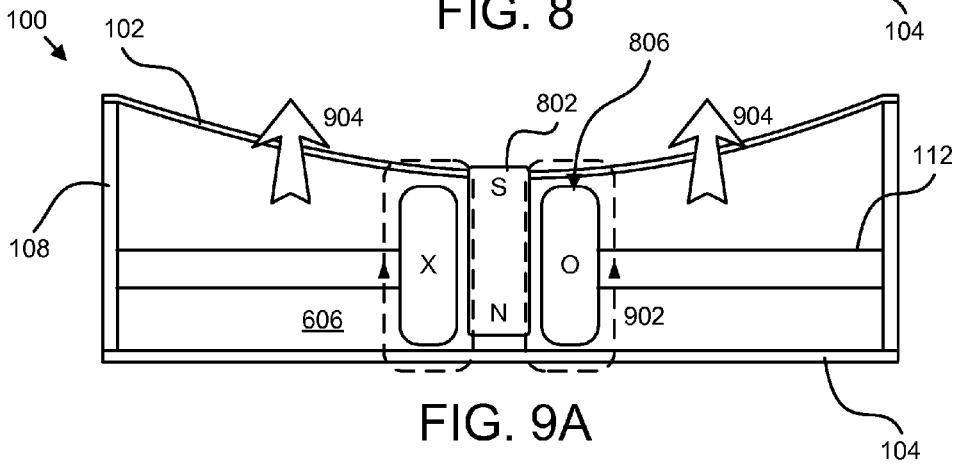
FIGS. 9A and 9B are cross-sectional top views of a fluid flow apparatus illustrating exemplary oscillation and induced fluid flow in accordance with the present invention.
Figure 9B:
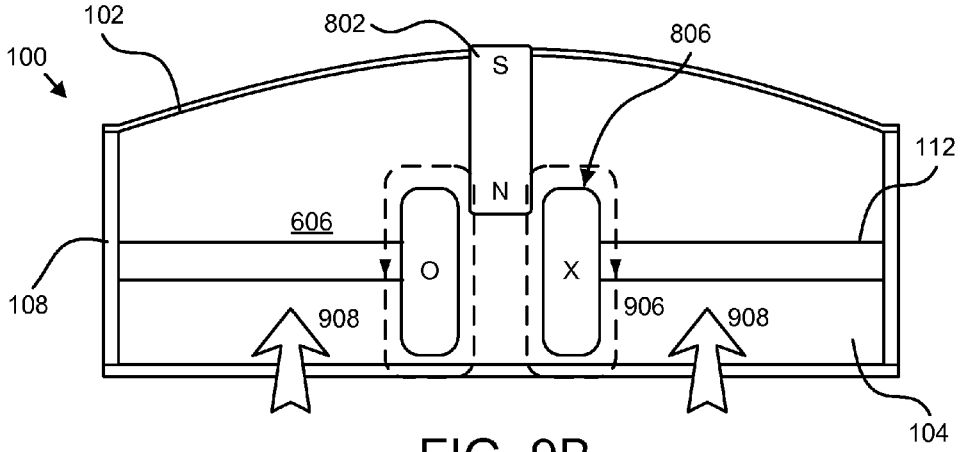

FIGS. 9A and 9B illustrate exemplary operation of the fluid flow apparatus 100 of FIG. 8 and depict its exemplary state at different points of an oscillation. FIG. 9A illustrates the flexing of the first membrane 102 towards the interior of the cavity 606, according to one embodiment. The solenoid 806 of the oscillation module is depicted as inducing a magnetic field 902 aligning with the polarity of the plunger magnet 802. In one embodiment, the magnetic fields 902 are induced by a current running through the solenoid 806. In one embodiment, in order to induce the magnetic field 902 a current flows through the solenoid as indicated by the "X" and "O". The "X" indicates that the current is flowing away from the viewer on the left side of the solenoid 806 while the "O" indicates that the current is flowing towards the viewer on the right side of the solenoid 806.

According to the depicted embodiment the plunger magnet 806 is pulled downward by the magnetic field 902 resulting in the inward flexing of the first directional membrane 102. In one embodiment, the inward flexing of the first directional membrane 102 creates an increased pressure within the cavity 606 and induces fluid to flow through the first directional membrane 102 out of the cavity, as indicated by arrows 904. According to one embodiment, fluid is not allowed to flow out of the cavity 606 through the second directional membrane 104 because it is oriented such that it resists flow in that direction (see arrows 808 of FIG. 8). Thus, as the first directional membrane 102 is drawn inward fluid may be forced out of the cavity in the direction of arrows 904.

FIG. 9B illustrates the flexing of the first directional membrane 102 away from the interior of the cavity 606. The solenoid 806 is depicted having a reversed flow of current with the current flowing towards the viewer on the left side of the solenoid 806, as indicated by the "O" and the current flowing away from the viewer on the right side of the solenoid 806, as indicated by the "X". The reversed current flow through the solenoid 806 induces a reversed magnetic field 906 which repels the plunger magnet 802 out of the solenoid 806 which forces the first directional membrane 102 to flex outwards.

In one embodiment, with the first directional membrane 102 being forced outwards the volume of the cavity 606 is increased. This increase may create a decreased pressure within the cavity allowing fluid to flow through the second directional membrane 104 into of the cavity, as indicated by arrows 908. According to one embodiment, fluid is not allowed to flow into the cavity 606 through the first directional membrane 102 because it is oriented such that it resists flow in that direction (see arrows 808 of FIG. 8). Rather, as the first directional membrane 102 moves away from the interior of the cavity 606, a fluid may be pushed in front of it. Thus, as the membrane 102 is pushed away from the solenoid 806 of the oscillation module fluid may be forced into the cavity in the direction of arrows 908.

According to one embodiment, an electrical signal may be supplied to the solenoid 806 of the oscillation module to create the alternating current flow and magnetic fields 902, 906. The alternating magnetic field may provide an alternating push or pull on the plunger magnet 802 and thus induce oscillation of the directional membrane 102. According to one embodiment, as the oscillation continues the repeated repelling and pulling on the plunger magnet 802 by the solenoid 806 continues to oscillate the directional membrane 102 and produces an overall fluid flow through the cavity 606 in the direction of arrows 904 and 908.

The solenoid 806 and plunger magnet 802 of FIGS. 8 and 9A-9B are exemplary only. The operation of the solenoid 806 and plunger magnet 802 is only superficially explained to more clearly set forth operation and function of the directional membrane 102, 104. One of skill in the art will recognize in light of the present disclosure numerous ways to modify and or vary the solenoid 806.

According to the above embodiments, the oscillation module 106 induces an oscillation in one or more directional membranes via a magnetic field. However, one of skill in the art will recognize numerous other methods for inducing an oscillation in a directional membrane. According to other embodiments within the scope of the present invention, any method of mechanical actuation known in the art may be used. For example, one or more electric motors may be used to induce the oscillation. In one embodiment, an electric motor may actuate one or more arms which may oscillate one or more directional membranes to induce fluid flow. Numerous other methods of inducing an oscillation are also possible and may be desirable in some embodiments.

Figure 10:
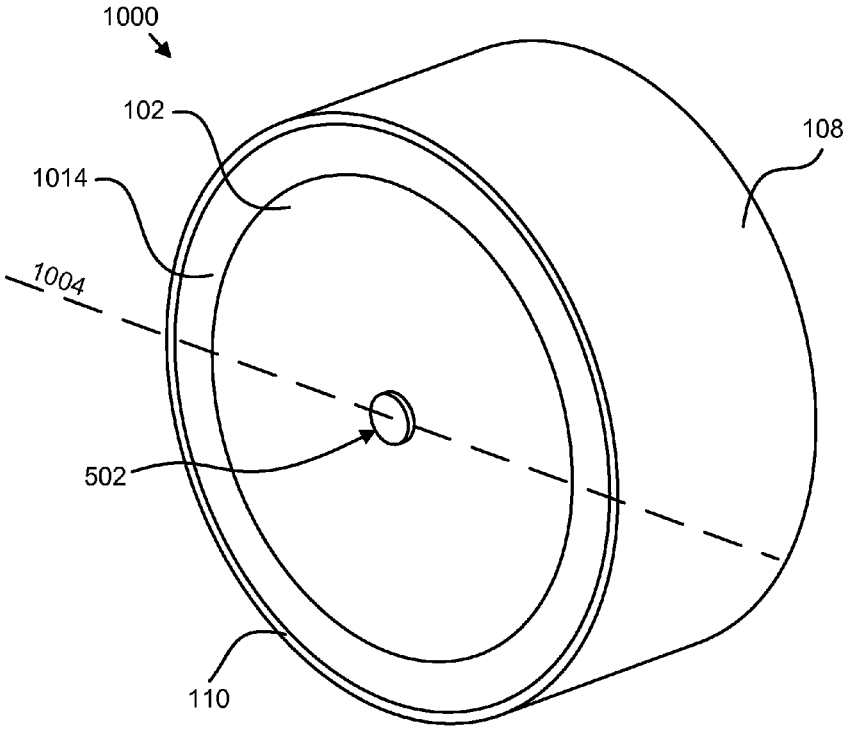
FIG. 10 is a perspective view of a fluid flow apparatus in accordance with the present invention.

FIG. 10 is a perspective view of a fluid flow apparatus 1000 having one or more rigid membranes, according to one embodiment. The fluid flow apparatus 1000, includes a first directional membrane 102, a second directional membrane 104 (not visible), a structure 108, and a flexible wall 1014. A magnet 502 is depicted affixed to the first directional membrane 102.

According to one embodiment, the first directional membrane 102 is at least partially rigid and may not be able to flex in a manner discussed in relation to previous embodiments. In one embodiment, the flexible wall 1014 allows the first directional membrane 102 to move inward and outward to induce fluid flow, in a manner similar to previous embodiments. Similar to previous embodiments, the fluid flow apparatus 100 may include an oscillation module 106 (not visible) which induces an oscillation of the directional membrane 102.

Figure 11:
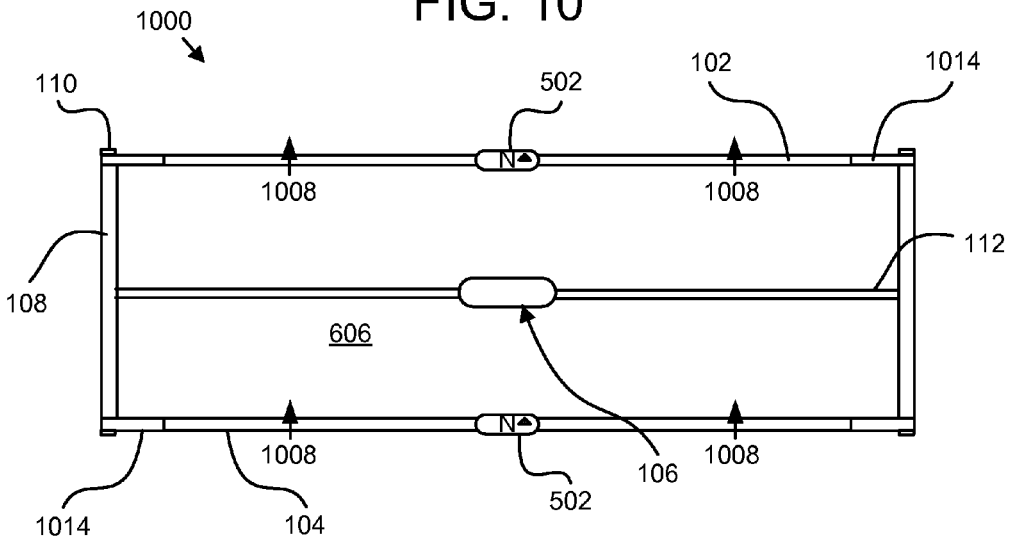
FIG. 11 is a cross-sectional top view of the fluid flow apparatus of FIG. 10 in accordance with the present invention.

Turning now to FIG. 11, an exemplary cross-sectional top view of the fluid flow apparatus 1000 taken along a slice indicated by line 1004, is shown. The top view reveals the cross-sectional shape and internal components of the fluid flow apparatus 1000, according to one embodiment. The first directional membrane 102, second directional membrane 104, structures 108, and oscillation module are visible. The structure 108 and the first and second directional membranes 102, 104 are depicted enclosing a cavity 606.

The directional membranes 102, 104 may be oriented such that they allow fluid flow in the direction indicated by arrows 1008. In the depicted embodiment, the first directional membrane 102 allows fluid to flow from within the cavity 606 through the first directional membrane 102 and out of the cavity 606. The second directional membrane 104 allows fluid to flow from without the cavity 606 through the second directional membrane 104 into the cavity. According to one embodiment, as the oscillation module 106 induces oscillation of the directional membranes 102, 104 fluid is forced to flow in the direction indicated by the arrows 1008.

According to the depicted embodiment, each of the first directional membrane 102 and the second directional membrane 104 has an attached magnet 502. In other embodiments, the directional membrane 104 may include any type of magnetic material. In the depicted embodiment, the magnets 502 are oriented such that their magnetic fields align. In the embodiment of FIG. 11, the oscillation module 106 includes an electromagnet. The electromagnet may be used to create a magnetic field for imparting a force to the directional membranes 102, 104 via the attached magnets. According to one embodiment, the aligned magnetic fields of the magnets 502 may cause them to be repelled at the same time or attracted at the same time by a magnetic field induced by the electromagnet of the oscillation module 106.

In one embodiment, the flexible wall 1014 may allow the movement of the directional membranes 102, 104 inward and outward from the cavity 606. The flexible wall 1014 may be attached between the structure 108 and the first directional membrane 102. Another flexible wall 1014 may also be attached between the structure 108 and the second directional membrane 104. According to one embodiment, the flexible wall 1014 is impermeable to a fluid to be moved by the fluid flow apparatus 1000. According to one embodiment, the flexible wall 1014 may be formed of a flexible directional membrane. For example, the flexible wall 1014 may be formed of a material or in a manner similar to the directional membranes of FIGS. 7A and 7B.

The above embodiments illustrate membranes that are substantially parallel to each other. This may be desirable in some embodiments in order to create a more compact fluid flow apparatus 100. However, directional membranes need not be substantially parallel and may be oriented in any position with respect to each other according to varying embodiments. For example, in one embodiment a first directional membrane may be orthogonal to a second directional membrane. In one embodiment, each directional membrane may include a separate oscillation module. In one embodiment, even orthogonal directional membranes may share a single oscillation module. For example, a single electromagnet may create a field that interacts with magnetic materials of orthogonal membranes. In one embodiment, more than one device may be used to actuate a single membrane. In one embodiment, multiple oscillation modules may be used to induce an oscillation in a single directional membrane.

Additionally, many of the above embodiments illustrate magnets attached or embedded in directional membranes. However, other embodiments may include any magnetic material such as a magnetic metal. The magnetic material need not have a magnetic polarity in order to induce oscillation. For example, an electromagnet may attract a non-polarized magnetic material to attract a portion of a membrane while tension or flexibility of some material may pull the magnet away from a drawn in position. For example, an alternating repelling and drawing by the electromagnet may not be necessary in some embodiments as a pulling by the electromagnet on a magnet material in combination with tension of the membrane or a flexible wall may induce an oscillation. One of skill in the art will recognize numerous other variations on the magnet and membrane in light of the present disclosure that fall within the scope of the present disclosure.

Although the previous embodiments illustrate round or circular directional membranes, and or fluid flow apparatuses these shapes are exemplary only. Other embodiments may include round, rectangular, triangular, or any other shaped membranes. One of skill in the art will recognize in light of the present disclosure numerous variations on the size and shape of the membranes without departing from the scope of the present invention.

Figure 12A:
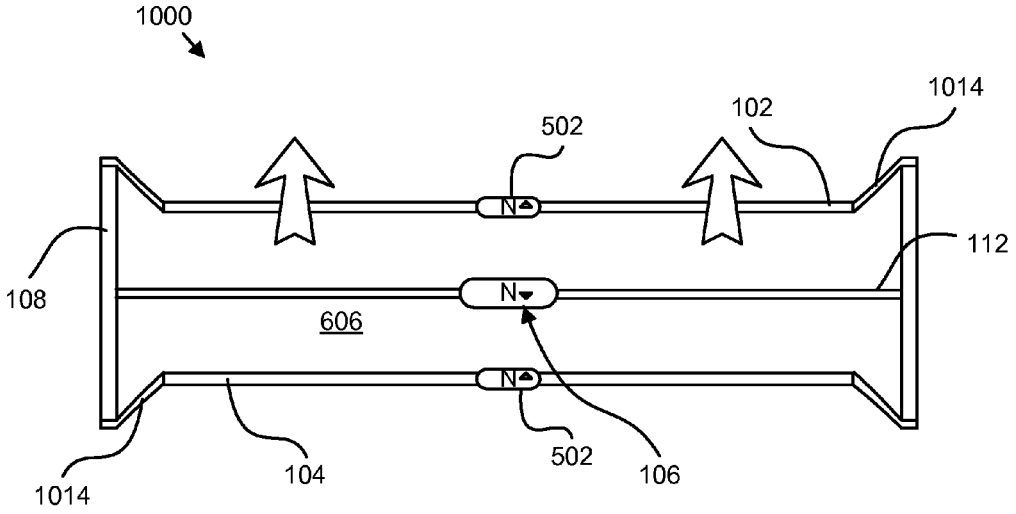
FIGS. 12A and 12B are cross-sectional top views of a fluid flow apparatus illustrating exemplary oscillation and induced fluid flow in accordance with the present invention.
Figure 12B:
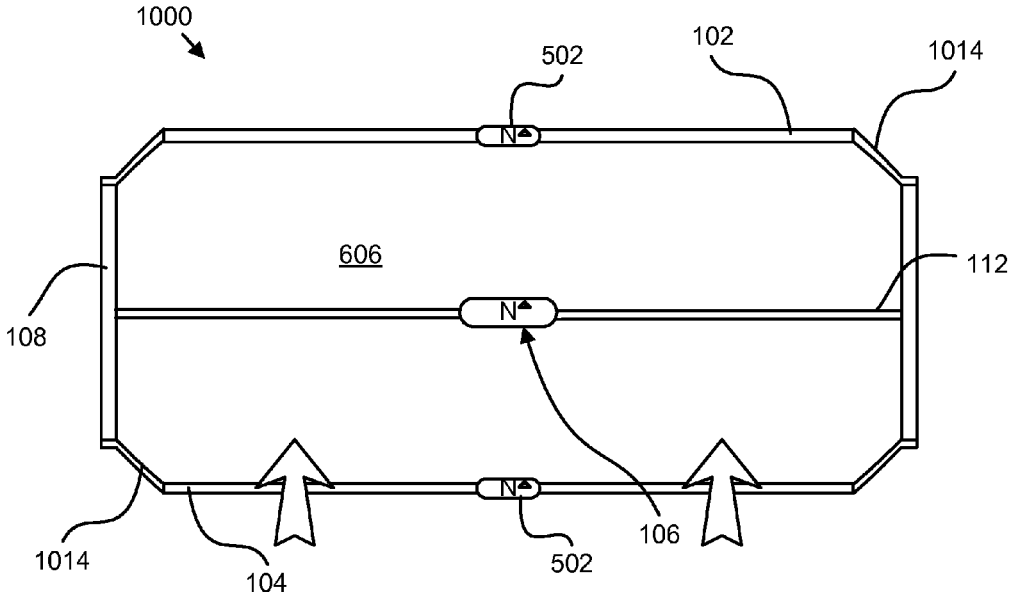

FIGS. 12A and 12B illustrate exemplary operation of the fluid flow apparatus 100 of FIG. 11 and depict its exemplary state at different points of an oscillation. The states of FIGS. 12A and 12B are similar to the states depicted in FIGS. 7A and 7B except that the directional membranes are rigid. Thus, the discussion provided in relation to the previous figures also applies to FIGS. 12A and 12B.

In one embodiment, the rigid directional membranes 102, 104 of FIGS. 10, 11, and 12A-12B may not include an attached magnet 502. In one embodiment, the rigid directional membranes 102, 104 may instead be at least partially formed of a magnetic material. For example, the rigid directional membranes 102, 104 may include a metal which may interact with a magnetic field created by an electromagnet.

Figure 13:
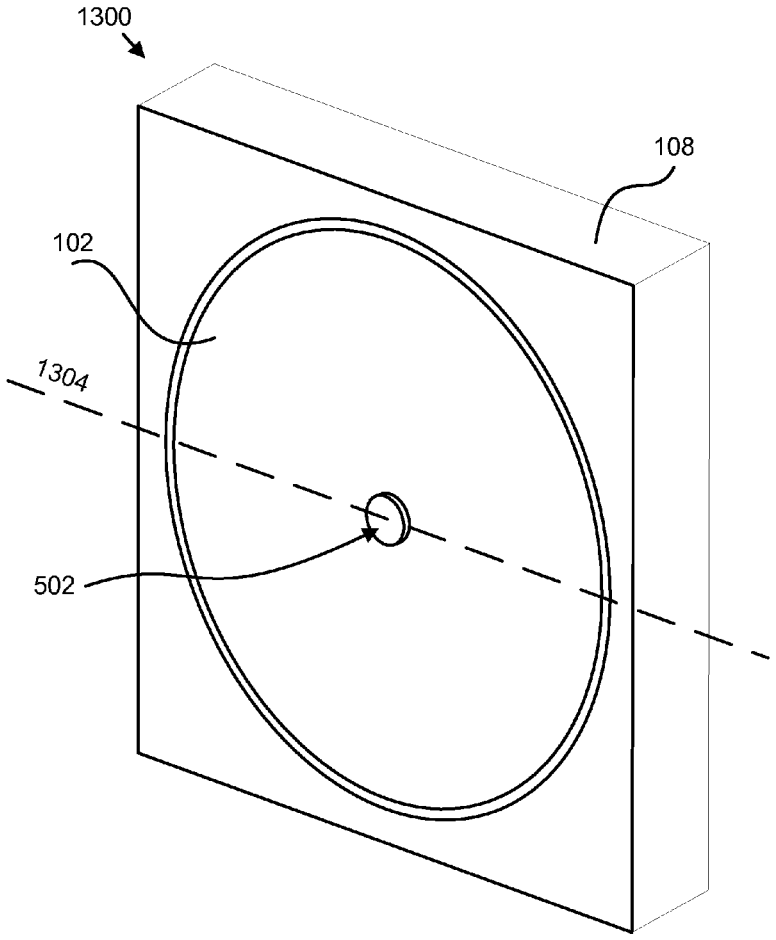
FIG. 13 is a perspective view of a fluid flow apparatus in accordance with the present invention.
Figure 14:
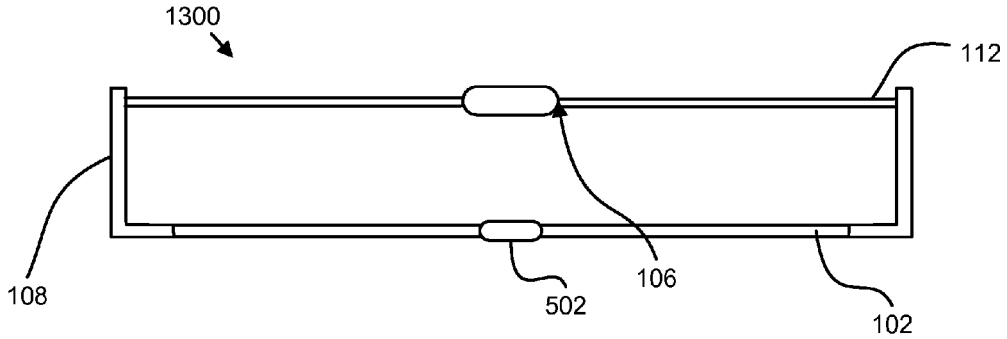
FIG. 14 is a cross-sectional top view of the fluid flow apparatus of FIG. 13 in accordance with the present invention.

FIGS. 13 and 14 illustrate another exemplary embodiment of a fluid flow apparatus 1300 having one directional membrane. FIG. 13 is a perspective view of the fluid flow apparatus 1300. FIG. 14 illustrates a cross-sectional view of the fluid flow apparatus 1300 taken along the line 1304.

The fluid flow apparatus 1300 includes a directional membrane 102, a structure 108, an oscillation module 106 that includes an electromagnet. The directional membrane 102 has an attached magnet 502. According to one embodiment, the electromagnet of the oscillation module 106 may operate in a manner similar to that described in relation to FIGS. 7A and 7B except that there is only a single directional membrane.

In the depicted embodiment, the fluid flow apparatus 1300 does not include a cavity or another directional flow mechanism. In one embodiment, the apparatus 1300 may be mountable to a structure that includes a cavity to induce air flow through the cavity. For example, the apparatus 1300 may be mounted on a computer case to act as a fan for the components within the case. According to one embodiment, the apparatus 1300 may be used in conjunction with another directional air flow device to move air through the case. For example, the apparatus 1300 may be mounted at one end of a computer case while a separate directional flow mechanism, or a second fluid flow apparatus 1300, may be mounted at another end of the case.

Figure 15:
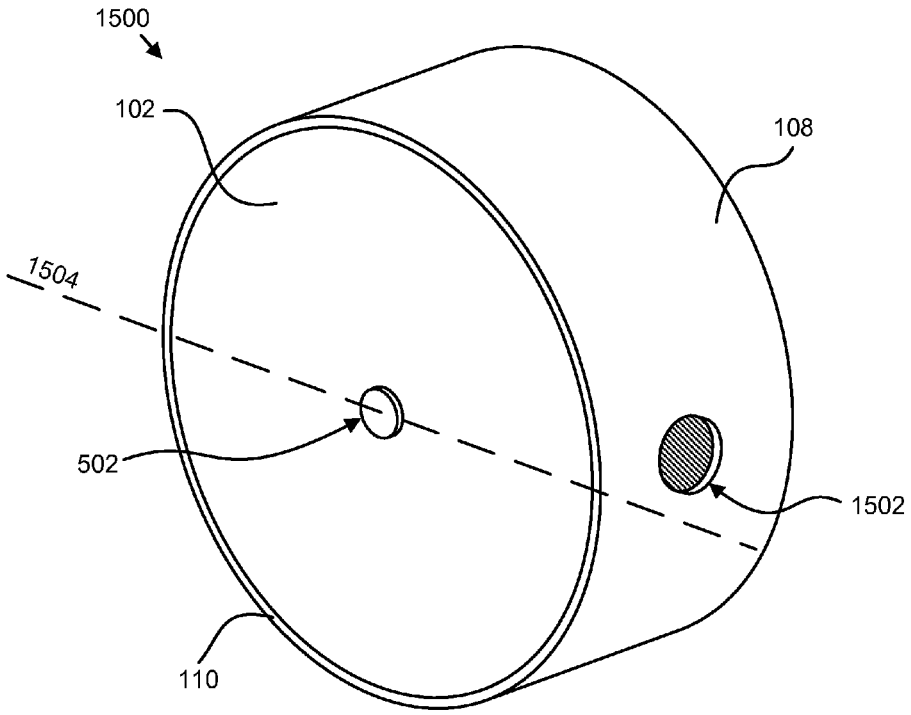
FIG. 15 is a perspective view of a fluid flow apparatus in accordance with the present invention.
Figure 16:
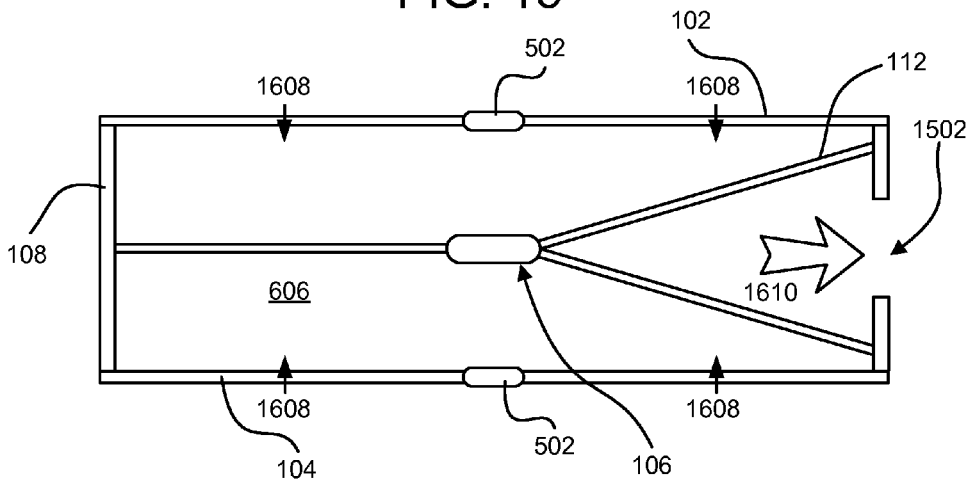
FIG. 16 is a cross-sectional top view of the fluid flow apparatus of FIG. 15 in accordance with the present invention.

FIGS. 15 and 16 illustrate yet another embodiment of a fluid flow apparatus 1500 in accordance with the present invention. FIG. 15 illustrates a perspective view of the apparatus 1500 while FIG. 16 illustrates a cross-sectional side view of the apparatus taken along the line 1504.

The fluid flow apparatus 1500 is similar to the fluid flow apparatus of FIGS. 5 and 6. The apparatus 1500 includes two directional membranes 102, a structure 108, and an oscillation module. However, the structure 108 includes a third opening 1502. Additionally, the directional membranes 102, 104 are oriented to allow fluid flow in the directions indicated by arrows 1608. Specifically, the both the first directional membrane 102 and the second directional membrane 104 are oriented to allow fluid flow into the cavity 606 but resist fluid flow out of the cavity 606.

According to one embodiment, the fluid flow apparatus 1500 may be used to induce fluid flow in through the first and second directional membranes 102, 104 and outward through the third opening 1502 in the direction indicated by arrow 1610. According to one embodiment, a directional flow mechanism such as a pressure actuated valve or a third directional membrane may be placed over the third opening 1502 to resist fluid flowing through the third opening 1502 into the cavity 606.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a directional membrane comprising a plurality of valves extending through the directional membrane, wherein the plurality of valves allows a fluid to pass through the directional membrane in a first direction and resists fluid passing through the directional membrane in a second direction, wherein the directional membrane comprises an attachment region coupled to a portion of a structure and a suspended region disposed over an opening in the structure, wherein the directional membrane is constructed from a material selected from the group consisting of plastic, rubber, and a polymeric material;

a directional flow mechanism that allows a fluid to flow in a third direction and resists fluid flow in a fourth direction, wherein the directional flow mechanism comprises a portion of the structure, wherein a cavity is disposed within the structure, wherein the first direction and the fourth direction are directed away from an interior of the cavity and the second direction and the third direction are directed towards the interior of the cavity; and an oscillation module that induces an oscillation in the directional membrane, the oscillation module comprising a magnetic material attached to the directional membrane, and an electromagnet coupled to a supporting arm and disposed in the cavity, wherein the electromagnet moves the magnetic material in the first direction and the second direction, wherein movement of the magnetic material in the second direction moves the entire suspended region of the directional membrane in the second direction and induces a flow of fluid in the first direction through the plurality of valves in the directional membrane while resisting a flow of fluid through the directional flow mechanism, wherein movement of the magnetic material in the first direction moves the entire suspended region of the directional membrane in the first direction and resists a flow of fluid through the plurality of valves in the directional membrane while inducing a flow of fluid in the third direction through the directional flow mechanism, and wherein the oscillation module induces an oscillation in the directional membrane by creating a changing magnetic field which selectively attracts and repels the magnetic material of the directional membrane.

2. The apparatus of claim 1, wherein the magnetic material comprises a magnetic plunger attached to the directional membrane and the electromagnet comprises a solenoid.

3. The apparatus of claim 1, wherein the directional membrane comprises a flexible material.

4. The apparatus of claim 1, wherein the directional membrane is comprised in a first directional membrane and the directional flow mechanism comprises a second directional membrane.

5. The apparatus of claim 1, wherein one or more of the valves comprises a three-dimensional funnel shape.

6. The apparatus of claim 1, wherein one or more of the valves comprises a flap.

7. A method for inducing fluid flow comprising:

providing a directional membrane comprising a plurality of valves extending through the directional membrane, wherein the plurality of valves allows a fluid to pass through the directional membrane in a first direction and resists fluid passing through the directional membrane in a second direction, wherein the directional membrane comprises an attachment region coupled to a portion of a structure and a suspended region disposed over an opening in the structure, wherein the directional membrane is constructed from a material selected from the group consisting of plastic, rubber, and a polymeric material;

providing a directional flow mechanism that allows a fluid to flow in a third direction and resists fluid flow in a fourth direction, wherein the directional flow mechanism comprises a portion of the structure, wherein a cavity is disposed within the structure, wherein the first direction and the fourth direction are directed away from an interior of the cavity and the second direction and the third direction are directed towards the interior of the cavity; and inducing an oscillation in the directional membrane with an oscillation module, the oscillation module comprising a magnetic material attached to the directional membrane, and an electromagnet coupled to a supporting arm and disposed in the cavity, wherein the electromagnet moves the magnetic material in the first direction and the second direction, wherein movement of the magnetic material in the second direction moves the entire suspended region of the directional membrane in the second direction and induces a flow of fluid in the first direction through the plurality of valves in the directional membrane while resisting a flow of fluid through the directional flow mechanism, wherein movement of the magnetic material in the first direction moves the entire suspended region of the directional membrane in the first direction and resists a flow of fluid through the plurality of valves in the directional membrane while inducing a flow of fluid in the third direction through the directional flow mechanism, and wherein the oscillation module induces an oscillation in the directional membrane by creating a changing magnetic field which selectively attracts and repels the magnetic material of the directional membrane.

8. The method of claim 7, the method further comprising providing a changing electrical signal to the electromagnet to create the changing magnetic field, the changing magnetic field interacting with the magnetic material of the directional membrane inducing the oscillation in the directional membrane.

9. An apparatus comprising:

a structure comprising a first opening and a second opening and a cavity disposed within the structure between the first opening and the second opening;

a first directional membrane comprising an attachment region coupled to a portion of the structure and a suspended region disposed over the first opening in the structure, wherein the first directional membrane is constructed from a material selected from the group consisting of plastic, rubber, and a polymeric material, wherein the first directional membrane comprises a plurality of valves extending through the first directional membrane, wherein the plurality of valves allows a fluid to pass through the first directional membrane in a first direction and resists fluid passing through the first directional membrane in a second direction, the first direction substantially opposite the second direction, the first direction away from the interior of the cavity, the first directional membrane comprising a magnetic material;

a second directional membrane comprising an attachment region coupled to a portion of the structure and a suspended region disposed over the second opening in the structure, wherein the second directional membrane is constructed from a material selected from the group consisting of plastic, rubber, and a polymeric material, wherein the second directional membrane comprises a plurality of valves extending through the second directional membrane, wherein the plurality of valves allows a fluid to pass through the second directional membrane in a third direction and resists fluid passing through the second directional membrane in a fourth direction, the third direction substantially opposite the fourth direction, the third direction towards the interior of the cavity, the second directional membrane comprising a magnetic material;

an oscillation module that induces an oscillation in the first directional membrane and the second directional membrane, wherein the oscillation comprises the entire suspended region of the first directional membrane oscillating in the first and second directions and the entire suspended region of the second directional membrane oscillating in the first and second directions, thereby inducing a flow of the fluid through the cavity, wherein the oscillation module comprises an electromagnet and wherein the oscillation module induces an oscillation in the first directional membrane and the second directional membrane by creating an alternating magnetic field which selectively attracts and repels the magnetic materials of the first directional membrane and the second directional membrane.

* * * * *